US008083303B2

(12) United States Patent
Compagnucci

(10) Patent No.: US 8,083,303 B2
(45) Date of Patent: Dec. 27, 2011

(54) BUILT-IN SLIDING ROTATING ELEMENT FOR MODULAR CORNER CABINETS

(76) Inventor: Rossano Compagnucci, Osimo (IT)

( * ) Notice: Subject to any disclaimer, the term of this patent is extended or adjusted under 35 U.S.C. 154(b) by 958 days.

(21) Appl. No.: 11/991,989

(22) PCT Filed: Sep. 25, 2006

(86) PCT No.: PCT/IT2006/000681
§ 371 (c)(1),
(2), (4) Date: Mar. 13, 2008

(87) PCT Pub. No.: WO2007/036971
PCT Pub. Date: Apr. 5, 2007

(65) Prior Publication Data

US 2009/0051256 A1 Feb. 26, 2009

(30) Foreign Application Priority Data

Sep. 30, 2005 (IT) ..... MC20050018 U

(51) Int. Cl.
*A47B 81/00* (2006.01)
*A47B 97/00* (2006.01)
*A47B 88/00* (2006.01)

(52) U.S. Cl. ..... 312/322; 312/238

(58) Field of Classification Search ..... 312/238, 312/322, 273, 274, 334.24–334.43, 334.14, 312/299, 301, 349, 350, 334.22
See application file for complete search history.

(56) References Cited

U.S. PATENT DOCUMENTS

| | | | | |
|---|---|---|---|---|
| 844,447 | A * | 2/1907 | Gautier | 211/94.01 |
| 1,010,950 | A * | 12/1911 | Prather | 312/123 |
| 4,639,051 | A * | 1/1987 | DeBruyn | 312/275 |
| 4,959,582 | A * | 9/1990 | Meyer et al. | 312/307 |
| 5,752,756 | A * | 5/1998 | Compagnucci | 312/238 |
| 5,941,620 | A * | 8/1999 | Weber | 312/238 |
| 6,199,966 | B1 * | 3/2001 | Fulterer | 312/334.24 |
| 6,412,892 | B1 * | 7/2002 | Bonat | 312/334.47 |
| 6,682,159 | B2 * | 1/2004 | Compagnucci | 312/334.24 |
| 7,306,301 | B2 * | 12/2007 | Walburn | 312/334.32 |
| 2004/0232810 | A1 * | 11/2004 | Kreyenkamp | 312/322 |

FOREIGN PATENT DOCUMENTS

EP 0809956 * 3/1997

* cited by examiner

*Primary Examiner* — Darnell Jayne
*Assistant Examiner* — Timothy M Ayres
(74) *Attorney, Agent, or Firm* — Lowe Hauptman Ham & Berner LLP

(57) ABSTRACT

A built-in sliding rotating element for modular corner cabinets, which is capable of supporting a stack of storage elements; the said built-in element slides on a parallel pair of telescopic guides fixed to the two opposite sides of an intermediate support hinge, which is fixed in turn to the base of the column around which the said built-in sliding element rotates.

3 Claims, 3 Drawing Sheets

BUILT-IN SLIDING ROTATING ELEMENT FOR MODULAR CORNER CABINETS

The present patent application is related to a built-in sliding rotating element for modular corner cabinets, which is capable of supporting a stack of storage elements.

More precisely, the said built-in element is applied in kitchen modular base units designed to be positioned in a corner to connect two rectilinear sections of cabinets aligned along the two walls that converge into the said corner.

The said corner base units are normally equipped with two built-in internal elements, composed of metal frames provided with shelves or baskets used to store objects in general.

A first built-in external element is normally housed in the cabinet with door, while a second built-in internal element is placed in the rear area without door.

In this type of cabinets, in order to access the internal built-in element, it is necessary to extract the external built-in element from its housing, rotate it around a vertical axis and finally move the internal built-in element to the area immediately behind the door, which is originally occupied by the external built-in element.

A corner cabinet of this type is disclosed in the Italian patent for utility model no. 242483 by the same applicant, which also discloses a mechanism designed to automatically produce the sequence of movements described above after opening the door, that is to say extraction and rotation of the external built-in element, as well as simultaneous sliding of the internal element that replaces the first element.

Both built-in elements have the same structural configuration, with a first flat vertical frame fixed to the cabinet wall and a second flat vertical frame that slides with respect to the first frame and is equipped with means to support projecting shelves or baskets for storage purposes.

The fixed support frame of the external built-in element is screwed into the side where the door is hinged, while the fixed support element of the internal built-in element is screwed into the cabinet rear panel.

In view of the above, the purpose of the present invention is to eliminate a drawback that is frequently found in the external built-in element, which is related to precarious and unstable sliding.

The said external element comprises a sliding flat vertical frame formed of two uprights connected by an upper and a lower cross-piece.

Projecting support elements, such as shelves or baskets, are fitted to the said uprights.

The front upright of the frame is fitted with two squares to support the door stopped on a vertical plane perpendicular to the plane of the sliding flat frame, which is supported by only one horizontal, telescopic guide, on whose mobile rod the lower cross-section of the flat frame is laid and fixed.

The top of the rear upright of the sliding frame is fitted with a small bracket that is attached to an horizontal guide fixed inside the cabinet.

The telescopic guide is directly fixed to the base of a rotating column placed on the cabinet opening.

This means that, during the extraction of the external built-in element, the said telescopic guide remains still on the bottom of the cabinet, in aligned position with the fixed guide screwed into the cabinet side, while during the rotation of the same external built-in element, the same telescopic guide rotates together with its support column around the pivoting axis of the column itself.

As mentioned earlier, the telescopic guide is directly fixed to the base of the rotating support column, so that the said guide rotates towards the inside of the cabinet, grazing its bottom wall, without interfering with the simultaneous forward movement of the internal built-in element that surmounts the telescopic guide.

When the external built-in element is completely extracted and projects with respect to the sliding flat frame, the weight is discharged on the mobile rod of the telescopic guide, thus generating severe flexional and torsional stresses that cause the precarious and unstable reinsertion of the built-in element.

On the other hand, the small bracket applied to the top of the upright of the sliding frame does not contribute to the perfect balance of the reinsertion travel of the built-in element. In fact, the function of the small bracket is not to support the telescopic guide in supporting and guiding the said sliding frame. The said bracket is designed to attach the sliding guide to the fixed guide, in order to prevent the frame from turning over under the weight of the products stored on the support elements that project on the front of the sliding frame.

The use of a second telescopic guide fitted to the top of the rotating column is to be ruled out, since it would interfere with the movement of the internal built-in element, unless the latter is considerably reduced in height, thus unacceptably impairing its loading capacity.

The purpose of the present invention is to obtain a built-in sliding rotating element for installation in modular corner units, which is characterised by great stability and balance during the sliding travels and is not impaired by shaking or jamming that are typical of similar items, as described above.

Another purpose of the present invention is to obtain a built-in sliding rotating element for installation in modular corner units with the aforementioned characteristics, without the need to redesign its main constructive components or the components of the other built-in element, i.e. the translating, non-rotating element defined as "internal".

This result has been achieved with the built-in element of the invention because of the use of a parallel pair of telescopic guides fixed on opposite sides to the same intermediate support longitudinal member, which is in turn fixed to the base of the said rotating column.

For major clarity, the description of the built-in element of the invention continues with reference to the enclosed drawings, which have an illustrative, not limitative value, whereby:

Figure 1:
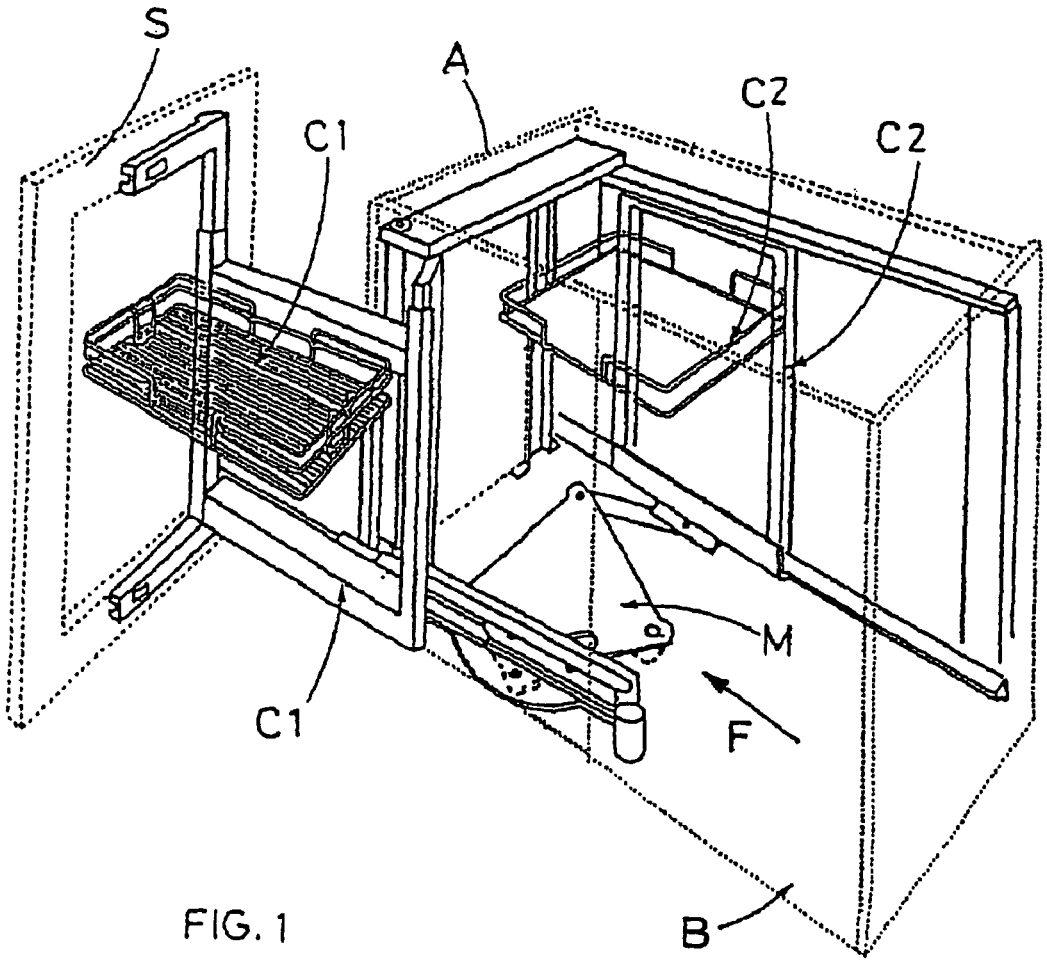
FIG. 1 PRIOR ART
FIG. 1 is a perspective diagrammatic view of a corner cabinet in which the built-in element of the invention can be installed.

With reference to FIG. 1, the built-in element (1) of the invention is designed to be installed in kitchen modular corner units of known type, which are internally equipped with two mobile elements, of which the first element (C1) is roto-translating and is housed in the compartment immediately behind the door (S), and the second element (C2) is sliding and is housed next to the first one, it being provided that a link mechanism (M) situated between the two shelves, in such a way that the rotation of the first element (C1) at the end of the extraction travel automatically determines the rectilinear movement of the second element (C2) that replaces the first element (C1), in the direction shown by the arrow (F).

In other words, the elements (C1 and C2) are the parts that are generically defined as "external built-in element" and "internal built-in element" in the introduction of this description.

The built-in element (1) of the invention comprises a sliding flat vertical frame (T) formed of two uprights (2 and 3) connected by a lower (4) and an upper (5) cross-piece.

Projecting support elements, such as shelves or baskets (not shown), are fitted to the said uprights (2 and 3).

The front upright (2) of the frame (T) is fitted with two squares (6) used to support the door (S), while the top of the rear upright (3) is fitted with a small bracket (7) that is attached to an horizontal guide (8) fixed inside the side (A) of the cabinet.

The built-in element (1) of the invention also comprises a column (10) that rotates around a vertical axis and is fitted on top of the said guide (8), while the base is directly fixed to the bottom (B) of the cabinet.

The peculiarity of the built-in element (1) of the invention consists in the use of a pair of telescopic guides (11*a*) and (11*b*) to support and guide the sliding frame (T).

These are two ordinary specular guides, a right-hand guide and a left-hand guide, of the type normally used on the two sides of drawers that slide on telescopic metal guides.

This pair of telescopic guides (11*a*) and (11*b*) is fixed on opposite sides to the two sides of an intermediate hinge (12*a*), which is an integral part of a metal longitudinal member (12) rigidly fixed to the base of the rotating column (10).

The longitudinal member (12) is preferably obtained by perforating and bending a metal sheet to obtain a U-shaped boxed profile with holes (13*a* and 12*b*) on the borders for fixing screws.

One border of the said box-shaped longitudinal member (12) coincides with the hinge (12*a*), so that one (11*a*) of the two telescopic guides is placed inside the box-shaped longitudinal member (12), while the other border (12*b*) is fixed at the base of the rotating column (10) by means of screws inserted into the holes (13*b*).

The lower cross-piece (4) of the frame (T) is placed and fixed above the last sliding rod of both telescopic guides (11*a* and 11*b*).

Figure 2:
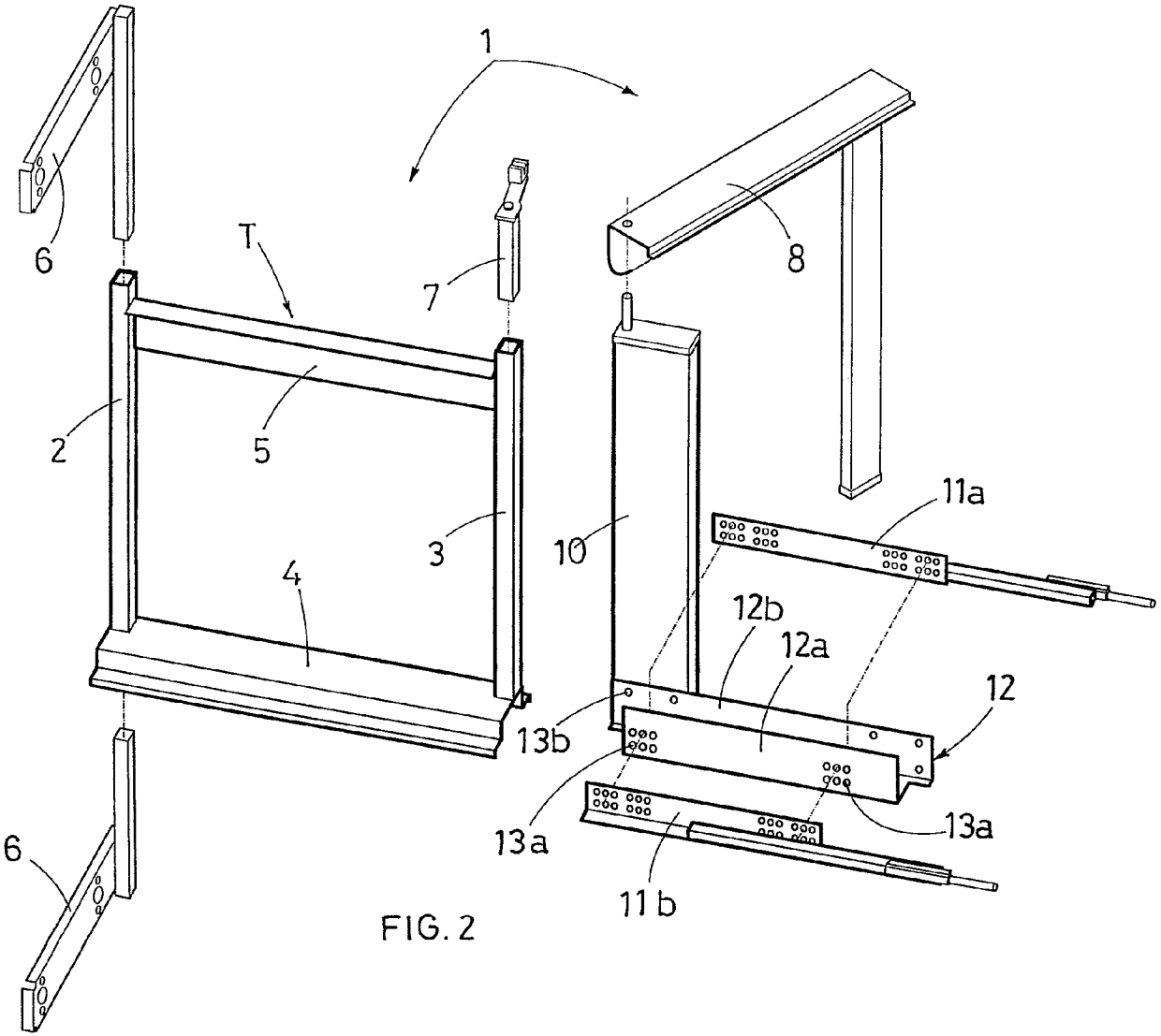
FIG. 2 is an axonometric exploded view of the built-in element of the invention.
Figure 3:
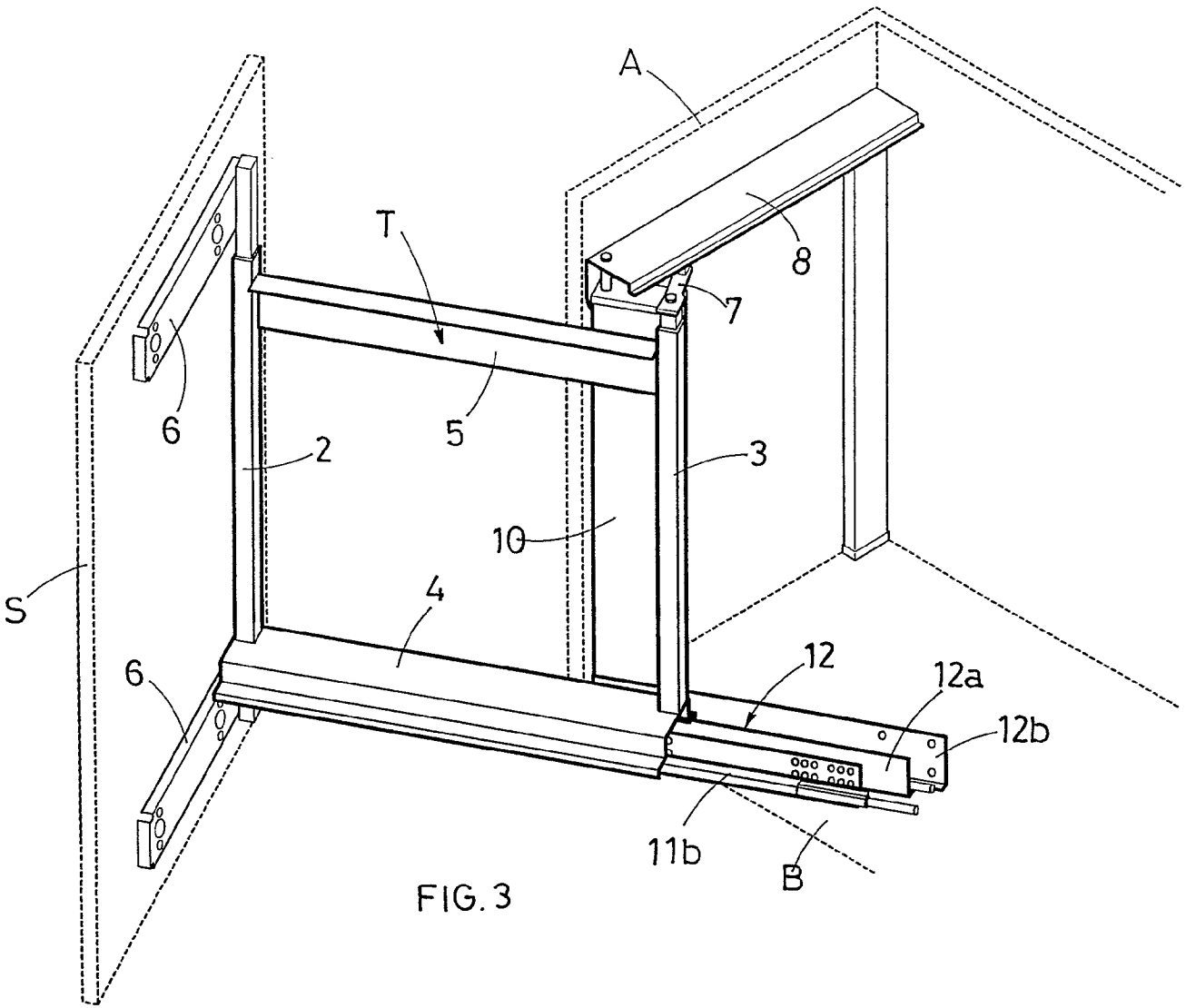
FIG. 3 is an axonometric view of the built-in element installed in a corner cabinet, when the door is completely extracted or rotated in order to provide access to the internal built-in element that has replaced the external element.

As shown in FIGS. 2 and 3, the cross-piece (4) is obtained with a metal sheet folded and shaped in such a way to have a two-pitch roof configuration, which also acts as cover to protect and hide the parallel pair of guides (11*a* and 11*b*) and the longitudinal member (12).

The invention claimed is:

1. Built-in sliding element suitable for corner cabinets of the type that comprises:

a flat sliding vertical frame (1) formed of two cross-pieces, a lower cross-piece (4) and an upper cross-piece (5);

two up-rights (2 and 3), a front up-right (2) and a rear up-right (3), necessary to connect said two cross-pieces (4 and 5); two squares (6), provided on the front up-right (2), necessary to support a door (S);

a small bracket (7), fitted at the top of the rear up-right (3);

an horizontal guide (8) fitted with the bracket (7) and fixed inside the side (A) of the cabinet;

a rotating column (10) with vertical axis directly fixed to the bottom (B) of the cabinet and supported by the horizontal guide (8);

built-in element (1) characterized in that it comprises:

a specular pair of telescopic guides (11*a*) and (11*b*) to support and guide the sliding frame (T);

an intermediate hinge (12*a*) on two opposite sides of which the two telescopic guides (11*a* and 11*b*) are fixed;

a bearing metal longitudinal member (12), incorporating said intermediate hinge (12*a*), rigidly fixed to the base of the rotting column (10);

it being provided that the lower cross-piece (4) of the frame (T) is placed and fixed above the last sliding rod of both telescopic guides (11*a*) and (11*b*).

2. Built-in sliding rotating element for modular corner cabinets as defined in claim 1, characterized in that the longitudinal member (12) has a U-shaped boxed configuration and its borders (12*a* and 12*b*) are provided with holes (13*a*) for the screws used to fix the telescopic guides (11*a* and 11*b*) to the intermediate hinge (12*a*) and holes (13*b*) for the screws used to fix the other border (12*b*) of the longitudinal member (12) to the base of the column (10).

3. Built-in sliding rotating element for modular corner cabinets, as defined in claim 1, characterized in that the cross-piece (4) has a two-pitch roof configuration and acts as cover to protect and hide the parallel pair of guides (11*a* and 11*b*) and the longitudinal support member (12).

* * * * *